US007691450B2

(12) United States Patent
Kenmoku et al.

(10) Patent No.: US 7,691,450 B2
(45) Date of Patent: Apr. 6, 2010

(54) PAINTING METHOD

(75) Inventors: Yasuyuki Kenmoku, Kakegawa (JP); Takehito Katsunuma, Yokohama (JP)

(73) Assignee: ABB K.K., Tokyo (JP)

( * ) Notice: Subject to any disclaimer, the term of this patent is extended or adjusted under 35 U.S.C. 154(b) by 616 days.

(21) Appl. No.: 10/581,297

(22) PCT Filed: May 24, 2005

(86) PCT No.: PCT/JP2005/009840

§ 371 (c)(1),
(2), (4) Date: Jun. 1, 2006

(87) PCT Pub. No.: WO2005/118156

PCT Pub. Date: Dec. 15, 2005

(65) Prior Publication Data

US 2007/0134430 A1 Jun. 14, 2007

(30) Foreign Application Priority Data

Jun. 1, 2004 (JP) ..... 2004-163602

(51) Int. Cl.

| | |
|---|---|
| ***B05D 1/02*** | (2006.01) |
| *B05B 3/00* | (2006.01) |
| *B05B 7/06* | (2006.01) |
| *B05D 7/00* | (2006.01) |

(52) U.S. Cl. ..... 427/421.1; 118/300; 118/313; 118/314; 118/315; 118/316; 118/220; 118/321; 118/323; 118/668; 118/681; 118/308; 427/8; 427/424; 427/427.2; 427/427.3

(58) Field of Classification Search ..... 427/421.1
See application file for complete search history.

(56) References Cited

U.S. PATENT DOCUMENTS 7,429,298 B2 * 9/2008 Krogedal et al. ..... 118/323

FOREIGN PATENT DOCUMENTS

| | | | |
|---|---|---|---|
| JP | 6-262564 | | 9/1994 |
| JP | 06262564 | A * | 9/1994 |
| JP | 8-224539 | | 9/1996 |
| JP | 9-52067 | | 2/1997 |
| JP | 2003-144990 | | 5/2003 |
| JP | 2003144990 | A * | 5/2003 |

OTHER PUBLICATIONS

Asakawa, N. and Y. Takeuchi, "Teachingless Spray-Painting of Sculptured Surface by an Industrial Robot", Proceedings of the 1997 IEEE International Conference on Robotics and Automation (1997).*

U.S. Appl. No. 10/581,520, filed Jun. 2, 2006, Kenmoku, et al.

* cited by examiner

*Primary Examiner*—Michael Kornakov
*Assistant Examiner*—Alexander Weddle
(74) *Attorney, Agent, or Firm*—Oblon, Spivak, McClelland, Maier & Neustadt, L.L.P.

(57) ABSTRACT

Two sprayer units are arranged along a conveyer. A coating surface of a panel conveyed by the conveyer is divided into four coating areas. Then, the sprayer units reciprocate parallel to the conveying direction and coat the individual coating areas. At this time, at the boundaries of the coating areas, the positions of the turning paths for reciprocation of the sprayer units are shifted from the front side to the rear side in the conveying direction and step-like coating trajectories are formed. As a result, the size of the area coated by each of the sprayer units can be expanded.

11 Claims, 12 Drawing Sheets

PAINTING METHOD

TECHNICAL FIELD

This present invention relates to a coating method on employing a sprayer unit to apply paint to an object to be coated, such as the body of an automobile, furniture or an electric appliance.

BACKGROUND ART

Generally, for the spray coating of an object having a comparatively large coating surface, like body of an automobile, furniture or electric appliances, a coating method is well known whereby the coating surface of the object to perform coating is divided into a plural number of segments (see, for example, Japanese Patent Laid-Open No. 2003-144990).

According to the arrangement disclosed in this prior art, two sprayer units are arranged on either right side and left side of the body of an automobile, and the upper surface of the body is coated by being divided into left and right coating areas. In this case, relative to the hood (bonnet) and the roof of the body of an automobile, the two sprayer units reciprocate (to the front and to the rear) in conveying directions of the body of an automobile and coat the individual coating areas.

To coat a large automobile, for example, coating surface will be larger than the amplitude (stroke) of the reciprocation of a sprayer unit in the conveying direction. Thus, when coating is performed, the coating surface must be divided into a plural number of coating areas in the conveying direction. In this case, when the conveying speed of the automobile body is slow and the size of the area coated per unit hour is comparatively small, a plural number of coating areas can be coated by use of a single sprayer unit. However, when the conveying speed of the automobile body is high, the size of the area to be coated per unit hour is increased and all the coating areas can not be coated by use of a single sprayer unit. Therefore, either the number of sprayer units must be increased to reduce the coating rate imposed on each sprayer unit or a tracking device must be employed to synchronize the movements of the sprayer unit to the automobile body and the coating available range must be expanded.

However, the increase in the number of sprayer units or the addition of equipment for a tracking device increases the initial costs associated with the introduction of the machines or the installation of other devices. In addition, since the size of the coating booth would be increased, other problems are that the cost of equipment for the coating booth and the cost of providing air conditioning are increased.

DISCLOSURE OF THE INVENTION

In view of the above-discussed problems with the prior art, it is an object of the present invention to provide a coating method whereby the size of the area coated by a sprayer unit can be increased and coating capacity can be improved relative to an object being conveyed.

To achieve this objective, the present invention is applied for a coating method providing conveying means for conveying an object to be coated in a predetermined direction and a plural number of sprayer units arranged at intervals in the conveying direction of the conveying means, and a coating surface of an object to be coated is divided into a plural number of coating areas and adjacent coating areas of the plural number of coating areas are respectively coated by different sprayer units.

(1) The feature of an arrangement employed by the present invention is that the individual sprayer units perform coating while reciprocating along the coating areas substantially parallel to the conveying direction of the object; and when the sprayer units are reciprocating substantially parallel to the conveying direction of the object, positions of turning paths of reciprocation located at a boundary between adjacent coating areas are sequentially shifted from the front side to the rear side in the conveying direction of the object, and coating is performed while forming coating trajectory of the turning paths like a series of steps.

Because of this arrangement, the coating available range of one sprayer unit can be substantially extended, compared with a coating method of prior arts that the positions of the turning paths for the reciprocation of the sprayer unit are fixed instead of being shifted from the front side to the rear side in the conveying direction.

Specifically, the conveying object to be coated is gradually transported away from the front of the sprayer unit. Thus, as the sprayer unit repeats reciprocation, the coating available range is gradually shifted to the rear in the conveying direction of the object, and the coating available range at the coating start time and the coating available range at the coating end time are shifted away from each other. At this time, when the positions of the turning paths for reciprocation are fixed as in the coating method of prior arts, the coating available range of the sprayer unit is limited to a range that the coating available range at the coating start time and the coating available range at the coating end time are overlapped. Thus, the coating available range of the sprayer unit is narrowed.

On the other hand, according to the arrangement of the present invention, in adjacent coating areas, the locations of the turning paths for reciprocation of the sprayer unit are sequentially shifted from the front side to the rear side in the conveying direction of the object. Therefore, even when the object to be coated is gradually moved away from the sprayer unit, as the sprayer unit repeats reciprocation, the range of the reciprocation is gradually shifted to the rear side in the conveying direction of the object. Therefore, since the range is not limited to an area where the coating available range at the coating start time and the coating available range at the coating end time are overlapped, the coating available range of the sprayer unit can be substantially expanded. Thus, the size of the area coated by a sprayer unit can be increased and the coating capacity can be improved. Consequently, the number of sprayer units required for an entire coating line can be reduced and the equipment expenses for the coating line and the maintenance expenses for the sprayer units can be reduced.

Furthermore, according to the invention, the positions of the turning paths for the reciprocation of the sprayer unit are sequentially shifted from the front side to the rear side in the conveying direction and coating is performed while forming the coating trajectory of the turning paths like a series of steps. Thus, the turning paths can be spread out. As a result, compared with cases that the turning paths are arranged at the same locations in the reciprocation direction or the turning paths are alternately moved in both reciprocation directions, color shading of an entire coating surface can be moderated and the quality of the finished coating can be improved.

(2) According to the arrangement of the present invention, it is preferable that; at first parallel transit path of parallel transit paths for reciprocation of the sprayer units being start positions of coating trajectories in the individual coating areas, coating is performed while moving the sprayer units from front side to rear side in the conveying direction, and at last parallel transit path being end positions of the coating trajectories in the individual coating areas, coating is performed while moving the sprayer units from the front side to the rear side in the conveying direction.

With this arrangement, when the coating of one coating area is completed and the coating of the next coating area is started to coat, the end position of the coating trajectory after the coating has been completed can be located near the start position of the coating trajectory before the coating was begun. Therefore, the time which coating is interrupted can be shortened and the size of the area coated by one sprayer unit can be increased.

(3) According to the arrangement of the invention, it is preferable that the parallel transit paths for reciprocation of the sprayer units are aligned substantially linearly in the adjacent coating areas.

With this arrangement, coating is performed in the adjacent coating areas so that the parallel transit paths along which the sprayer units reciprocate are aligned substantially linearly. Thus, the coating trajectory formed when one coating area has been coated can be linked almost linearly to the coating trajectory formed when the other coating area has been coated. Therefore, the same quality can be acquired for the finished coating as is obtained when the entire coating surface is regarded as a single coating area.

(4) In addition, according to the arrangement of the invention, coating may be performed in a manner that the positions of terminal ends of parallel transit paths in one direction for the reciprocation of the sprayer units and start ends of parallel transit paths in return direction are shifted from the front side to the rear side in the conveying direction of the object.

With this arrangement, at the turning paths provided for the reciprocation of the sprayer units, wasted movements can be eliminated, and the practical coating range available of each sprayer unit can be efficiently expanded.

(5) Moreover, according to the arrangement of the invention, coating is performed in the manner that paint is sprayed by the sprayer unit at parallel transit path and is cut at the turning paths for the reciprocation during the reciprocation of the sprayer unit.

With this arrangement, compared with case of which the spraying of paint is continued at the turning paths, the thickness of a coated film at the turning paths can be reduced. As a result, the thickness of the coated film at the turning paths can be nearly the same thickness as the coated film at the parallel transit paths. Thus, even when coating trajectories are formed by connecting two adjacent coating areas, color shading by unevenness at the joint position can be prevented to occur. Further, the quality of the finished coating across an entire coating surface, consisting of two coating areas, can be improved.

BEST MODE FOR CARRYING OUT THE INVENTION

Hereafter, a coating method according to the embodiment of the present invention is described more particularly with reference to the accompanying drawings.

Referring to FIGS. 1 to 6, there is shown a first embodiment of the present invention. An explanation will be given for the first embodiment by using an example wherein rotary atomizing type sprayer units attached to robot devices are employed to coat a panel constituting an external surface of a comparatively large furniture item or an electric appliance, for example.

Figure 1:
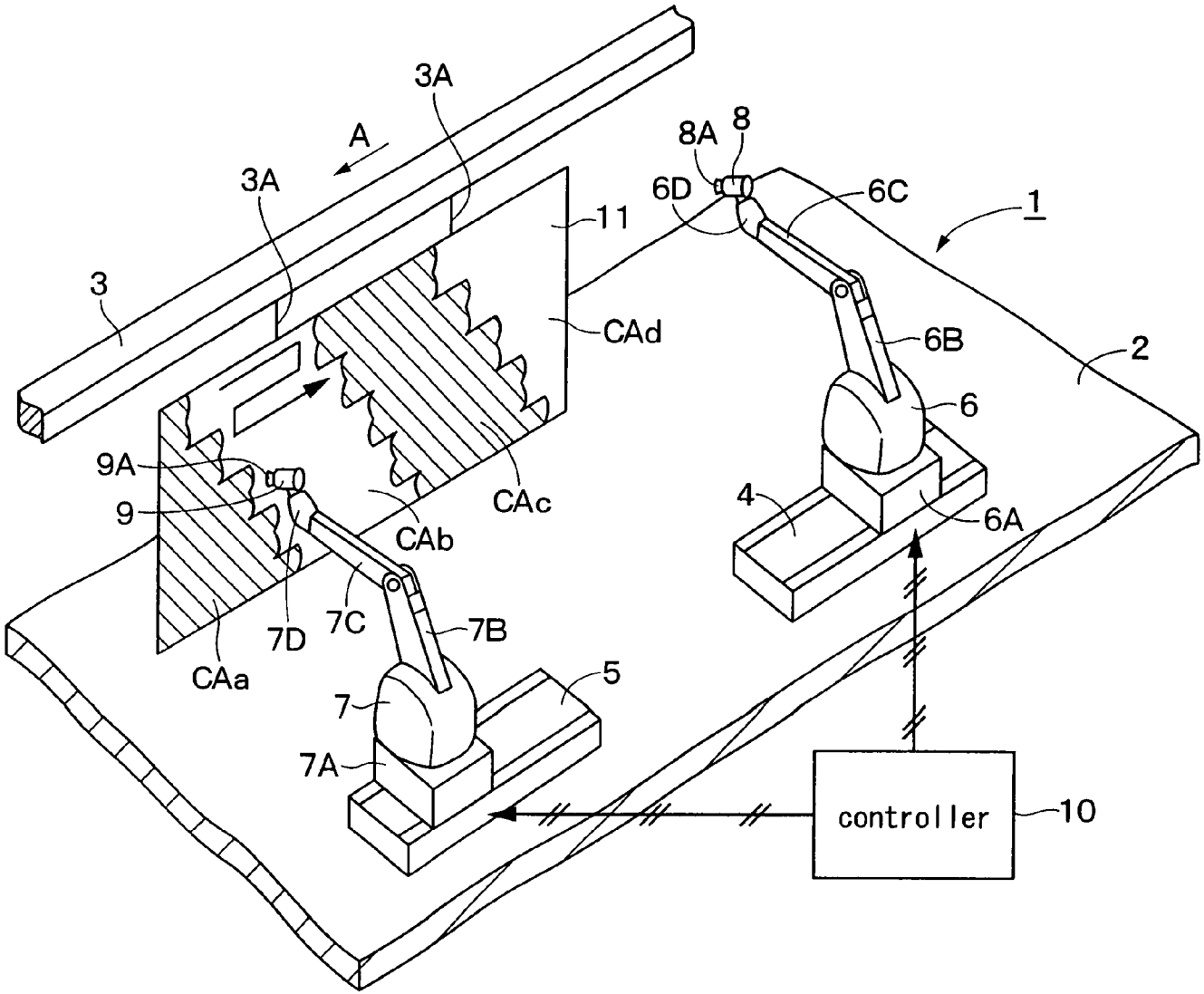
FIG. 1 is a perspective view of a coating apparatus used for a coating method according to a first embodiment of the present invention.

In FIG. 1, indicated at 1 is a coating apparatus located inside a coating booth 2. The coating apparatus 1 is roughly constituted by a conveyer 3, robot devices 6, 7 and rotary atomizing type sprayer units 8, 9, all of which will be described later.

Figure 2:
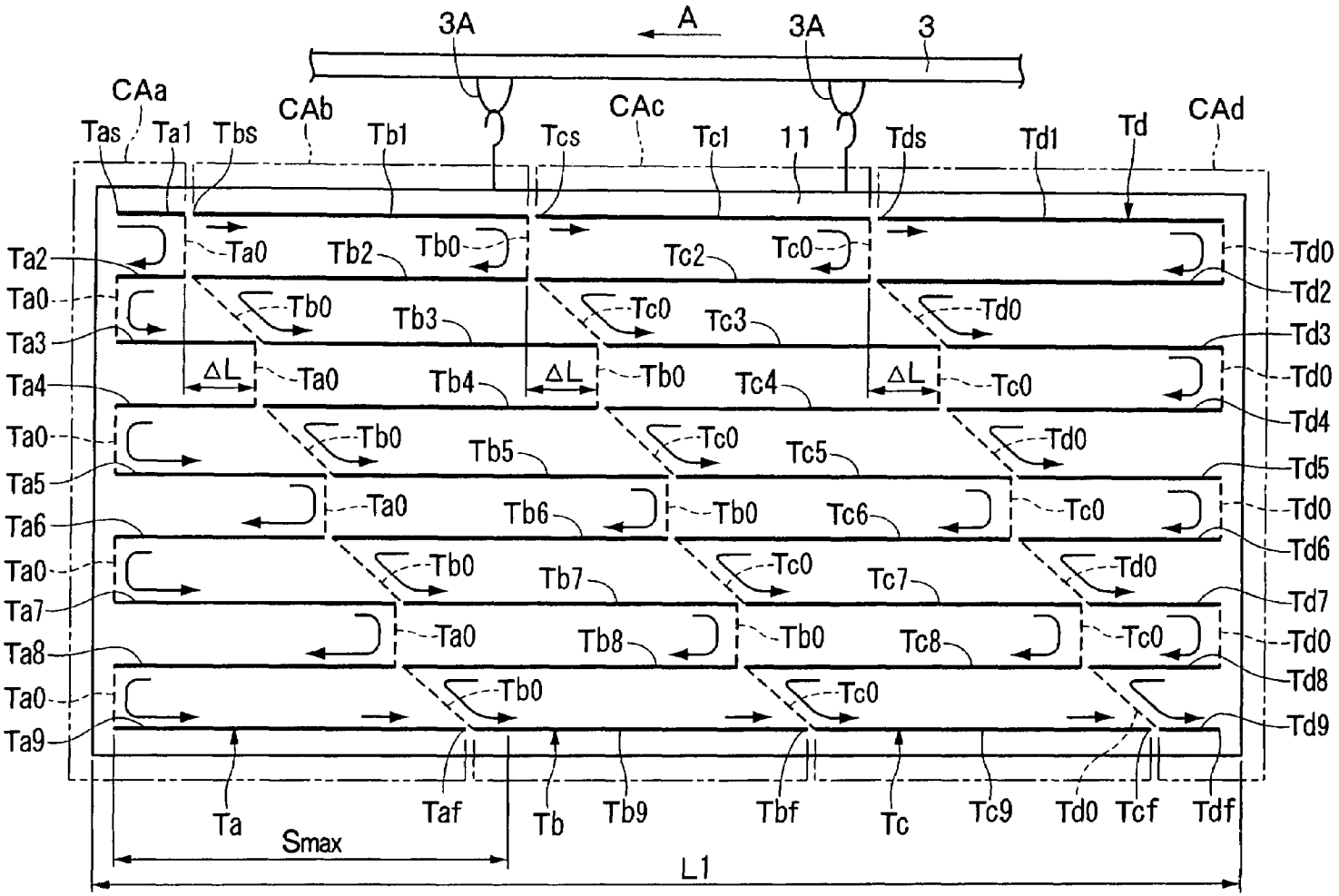
FIG. 2 is a front view of the coating trajectories for a rotary atomizing type sprayer unit for coating a panel in FIG. 1.

Indicated at 3 is a conveyer provided for the side of the ceiling of the coating booth 2. As shown in FIG. 2, the conveyer 3 is equipped with hangers 3A to suspend a panel 11 which will be described later. In this state, the panel 11 is conveyed at a predetermined speed in a direction indicated, for example, by an arrow A (lateral direction in FIG. 2).

Indicated at 4, 5 are two tracking devices mounted parallel to the conveyer 3. The tracking devices 4, 5 are located at a distance to the rear side (upstream) and to the front side (downstream) in the conveying direction of the conveyer 3, and are extended parallel to the conveying direction of the conveyer 3. The tracking devices 4, 5 independently move robot devices 6, 7, which will be described later, at arbitrary speeds in the conveying direction or in the opposite direction. With this arrangement, the tracking devices 4, 5 adjust moving speeds of the robot devices 6, 7 (sprayer units 8, 9) relative to the panel 11 that is conveyed by the conveyer 3.

Indicated at 6, 7 are robot devices of a multi-axial type that constitute operation devices for sprayer units. The robot devices 6, 7 are positioned along and to the side of the conveyer 3, and are mounted on the tracking devices 4, 5. Furthermore, the two robot devices 6, 7 are arranged at an interval to the rear side and to the front side relative to the conveying direction (the direction indicated by the arrow A) of the conveyer 3, and move the rotary atomizing type sprayer units 8, 9 which will be described later, to perform a coating operation.

The robot device 6 is roughly constituted by a base 6A movably mounted on the tracking device 4, a vertical arm 6B rotatably and swingably mounted on the base 6A, a horizontal arm 6C swingably mounted at the distal end of the vertical arm 6B, and a wrist 6D provided at the distal end of the horizontal arm 6C. Substantially the same as the robot device 6, the robot device 7 also is roughly constituted by a base 7A, a vertical arm 7B, a horizontal arm 7C and a wrist 7D.

In addition, the robot devices 6, 7 support the rotary atomizing type sprayer units 8, 9 at the wrists 6D, 7D. When the panel 11, which will be described later, is conveyed to a coating position by the conveyer 3, the robot devices 6, 7 move the vertical arms 6B, 7B and the horizontal arms 6C, 7C and so forth to reciprocate the sprayer units 8, 9 substantially parallel to the conveying direction along the panel 11 within the range defined by the maximum stroke width Smax.

Indicated at 8, 9 are the rotary atomizing type sprayer units respectively attached to the wrists 6D, 7D of the two robot devices 6, 7. At their distal ends of the sprayer units 8, 9, rotary atomizing heads 8A, 9A rotated at high speed is provided. The sprayer units 8, 9 are constructed that when paint is discharged from the rotary atomizing heads 8A, 9A the paint is atomized to fine particles by the centrifugal forces of the rotary atomizing heads 8A, 9A, and the fine particles of paint are sprayed on the panel 11 located to the front side.

Furthermore, shaping air outlets (not shown) are disposed around the outer walls of the rotary atomizing heads 8A, 9A of the sprayer units 8, 9. Shaping air is blown through the shaping air outlets from the rear, so as to enclose the paint sprayed from the rotary atomizing heads 8A, 9A. That is, the shaping air is used to prevent the paint which has been sprayed from the rotary atomizing heads 8A, 9A from spreading diametrically outward due to centrifugal force, and forms a circular spray pattern P (an atomizing pattern) of paint having a predetermined diameter.

Indicated at 10 is a controller connected to the robot devices 6, 7 (the sprayer units 8, 9). The controller 10 is disposed in a control chamber and controls a coating line, for example. In this case, the controller 10 is constituted by a computer that includes a program for controlling the tracking devices 4, 5, the robot devices 6, 7, the sprayer units 8, 9, an air control valve and a coating control valve (neither of them shown). The controller 10 adjusts the movements of the tracking devices 4, 5 and the robot devices 6, 7 (the traveling speeds of the sprayer units 8, 9), the quantities of the paint supplied by the sprayer units 8, 9, the pressure of the ejected shaping air and so forth.

Indicated at 11 is the panel that is used as an object to be coated. The panel 11 is a plate having an almost quadrilateral shape used as an external plate of steel furniture or an electric appliance, for example, and is sequentially conveyed in a direction indicated by an arrow A being suspended by the conveyer 3. Further, the panel 11 has a size L1 longer than the maximum stroke width Smax of the sprayer units 8, 9 in the conveying direction (the direction indicated by the arrow A) (see FIG. 2). The coating surface of the panel 11 is divided into four coating areas CAa to CAd from the front side to the rear side in the conveying direction. Of the individual coating areas CAa to CAd, the coating areas CAa, CAc are to be coated by the sprayer unit 8 located to the rear side in the conveying direction, and the coating areas CAb, CAd are to be coated by the sprayer unit 9 located to the front side in the conveying direction. Therefore, the coating areas CAa, CAc to be coated by the sprayer unit 8, and the coating areas CAb, CAd to be coated by the other sprayer unit 9 are alternately arranged in the conveying direction.

The coating apparatus 1 of the first embodiment has been constituted as previously described. With referring to FIGS. 2 through 6, an explanation will be given for a coating method according to this embodiment by employing as an example the coating of the panel 11.

Besides, in FIGS. 2 through 6, solid lines and dotted lines (broken lines), which are drawn to describe reciprocation routes across the coating surface of the panel 11 in the lateral direction (the direction indicated by the arrow A), designate coating trajectories (traveling trajectories) Ta, Tb, Tc, Td of the sprayer units 8, 9 (rotary atomizing heads 8A, 9A) to the coating surface of the panel 11. Furthermore, the solid lines of the coating trajectories Ta, Tb, Tc, Td designate parallel transit paths Ta1 to Ta9, Tb1 to Tb9, Tc1 to Tc9, Td1 to Td9 along which the sprayer units 8, 9 are moved in parallel in the lateral direction. The dotted lines of the coating trajectories Ta, Tb, Tc, Td designate turning paths Ta0, Tb0, Tc0, Td0, where the sprayer units 8, 9 turn and move. Further, the sprayer units 8, 9 are constituted to spray paint at the parallel transit paths Ta1 to Ta9, Tb1 to Tb9, Tc1 to Tc9, Td1 to Td9, and to cut the spraying of paint at the turning paths Ta0, Tb0, Tc0, Td0.

Figure 3:
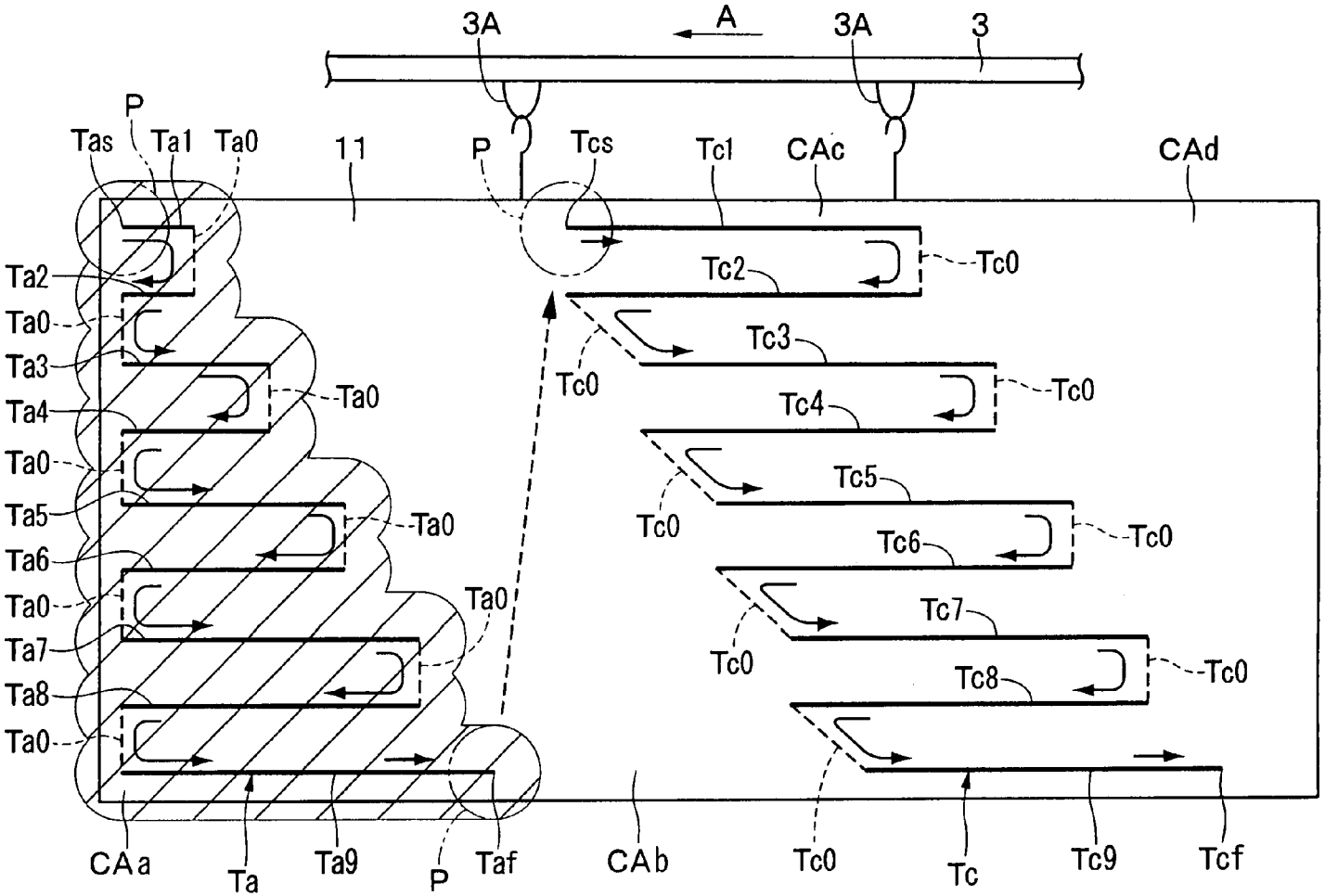
FIG. 3 is a front view of the panel in FIG. 2 coated the front end coating area in a conveying direction.

Initially, a first coating process will be described while referring to FIGS. 2 and 3. During the first coating process, while the panel 11 is conveyed by the conveyer 3, the panel 11 passes the vicinity of the sprayer unit 8 located upstream (to the rear side) in the conveying direction. At this time, the controller 10 employs the robot device 6 located to the rear side and the sprayer unit 8 (the sprayer unit 8 on the right in FIG. 1) to begin the coating of the coating area CAa, which is the front end portion of the coating surface of the panel 11 in the conveying direction. At this time, as shown in FIG. 3, the sprayer unit 8 is moved to the upper left corner of the panel 11 as a start position Tas of the coating trajectory Ta, and starts the spraying paint. As a result, the sprayer unit 8 forms a spray pattern P. Also, while continuing the spraying of paint, the sprayer unit 8 moves across the upper end side of the panel 11 along the first (the beginning) parallel transit path Ta1 from the front side to the rear side (opposite of the conveying direction) in the conveying direction.

When the sprayer unit 8 has moved in parallel with a predesignated distance in the opposite direction to the conveying direction of the panel 11 and has reached the terminal end of the parallel transit path Ta1, the sprayer unit 8 temporarily cuts the spraying of paint and moves downward on the panel 11 along the first turning path Ta0.

And, the sprayer unit 8 moves down from the parallel transit path Ta1 a distance that is smaller than the diameter of the spray pattern P, and reaches the terminal end of the turning path Ta0. At this time, the sprayer unit 8 resumes the spraying of paint and moves along the second parallel transit path Ta2 from the rear side to the front side in the conveying direction (forward in the conveying direction).

When the sprayer unit 8 has moved to the left end side of the panel 11 and has reached the terminal end of the parallel transit path Ta2, the sprayer unit 8 temporarily cuts the spraying of paint and moves downward on the panel 11 along the second turning path Ta0.

Sequentially, when the sprayer unit 8 has reached the terminal end of the second turning path Ta0, the sprayer unit 8 resumes the spraying of paint and moves to the opposite direction to the conveying direction along the third parallel transit path Ta3. When the sprayer unit 8 has reached the terminal end of the parallel transit path Ta3, the sprayer unit 8 temporarily stops the spraying of paint as at the first turning path Ta0, and moves downward on the panel 11 along the third turning path Ta0.

At this time, as at the first turning path Ta0 that connects the parallel transit paths Ta1 and Ta2, the third turning path Ta0 that connects the parallel transit paths Ta3 and Ta4 is located near the boundary between the two coating areas CAa and CAb. However, the third turning path Ta0 is positioned to the rear side in the conveying direction (the direction indicated by the arrow A) further than the first turning path Ta0, and the two turning paths Ta0 are separated from each other by a distance ΔL in the conveying direction (see FIG. 2).

Further, at the end of the parallel transit path Ta3, as at the first turning path Ta0, the sprayer unit 8 is moved down a distance equivalent to the first turning path Ta0 and reaches the terminal end of the third turning path Ta0. At this point, the sprayer unit 8 resumes the spraying of paint and moves forward in the conveying direction along the fourth parallel transit path Ta4.

In the same manner as the coating operation performed at the parallel transit path Ta1 to parallel transit path Ta4, the sprayer unit 8 repeats the following coating operation. Specifically, at the fifth to the ninth parallel transit paths Ta5 to Ta9, the sprayer unit 8 moves parallel to the conveying direction while performing the spraying of paint and at the fifth to eighth turning paths Ta0, the sprayer units 8 cuts the spraying of paint and moves downward, vertically crossing to the conveying direction. At this time, the positions of the fifth and seventh turning paths Ta0, as well as those of the first and third turning paths Ta0, are sequentially shifted at distances of Δ from the front side to the rear side in the conveying direction (see FIG. 2).

Following this, as shown in FIG. 3, when the sprayer unit 8 has moved across the lower end side of the panel 11 to the opposite direction to the conveying direction along the last parallel transit path Ta9, the sprayer unit 8 reaches an end position Taf of the coating trajectory Ta. At the end position Taf, the sprayer unit 8 temporarily cuts the spraying of paint and moves to a start position Tcs of the coating trajectory Tc in the next coating area CAc. At this time, the sprayer unit 8 skips the coating area CAb adjacent to the coating area CAa and moves to the coating area CAc located to the rear in the conveying direction further than the coating area CAb.

Next, a second coating process will be described while referring to FIGS. 2 and 4. In the second coating process, when the panel 11 is conveyed by the conveyer 3, the coating area CAc which is the middle rear portion of the coating surface of the panel 11 in the conveying direction is positioned in the vicinity of the sprayer unit 8 (the sprayer unit 8 on the right in FIG. 1) that has completed the coating of the coating area CAa.

Thus, just as the coating area CAa, the controller 10 employs the robot device 6 located to the rear side in the conveying direction and begins coating the coating area CAc which is the middle rear portion of the coating surface of the panel 11 in the conveying direction. At this time, as a start position Tcs of the coating trajectory Tc, the sprayer unit 8 moves to the intermediate portion in lateral direction in FIG. 3, near the terminal end of the first parallel transit path Tb1 in the upper portion of the panel 11, and begins spraying of paint. Thereafter, while continuing the spraying of paint, the sprayer unit 8 moves across the upper end side of the panel 11 along the first (beginning) parallel transit path Tc1 from the front side to the rear side in the conveying direction (the opposite of the conveying direction).

Next, the sprayer unit 8 moves in parallel with a predesignated distance in the opposite direction to the conveying direction of the panel 11 and reaches the terminal end of the parallel transit path Tc1. Since at this time the sprayer unit 8 is positioned near the start end of the parallel transit path Td1, the sprayer unit 8 temporarily stops the spraying of paint and moves downward on the panel 11 along the first turning path Tc0.

Sequentially, when the sprayer unit 8 has moved downward from the parallel transit path Tc1 a distance equivalent to the first turning path Ta0 and has reached the terminal end of the first turning path Tc0, the sprayer unit 8 resumes the spraying of paint and moves along the second parallel transit path Tc2 from the rear side to the front side in the conveying direction (forward in the conveying direction). In this manner, the sprayer unit 8 repeats the reciprocation in the conveying direction and gradually moves downward on the panel 11.

At this time, the positions of the four turning paths Tc0 located at the boundary between the coating areas CAc, CAd are shifted from the front side to the rear side in the conveying direction. Further, the positions of the four turning paths Tc0 located at the boundary between the coating areas CAb, CAc are also sequentially shifted from the front side to the rear side in the conveying direction. With this arrangement regarding to the coating trajectory Tc, the side portion at the boundary between the coating areas CAc, CAd is formed like a series of steps, and the side portion at the boundary between the coating areas CAb, CAc is also formed as a series of steps. Consequently, whole of the coating trajectory Tc has a substantially quadrilateral shape.

Figure 4:
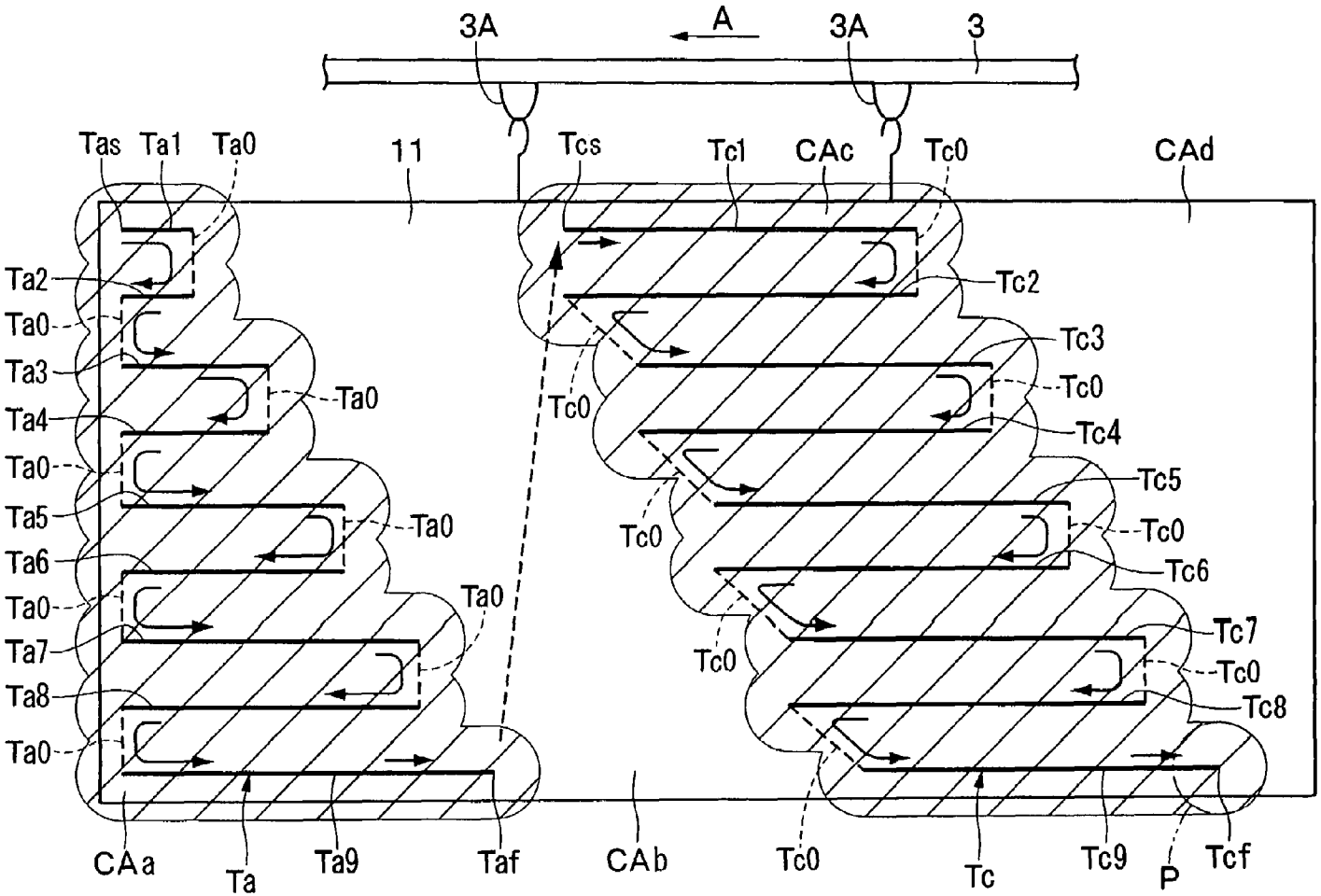
FIG. 4 is a front view of the panel in FIG. 2 sequential to FIG. 3 coated the middle rear coating area in the conveying direction.

Finally, as shown in FIG. 4, when the sprayer unit 8 has moved on the lower end side of the panel 11 in the opposite direction to the conveying direction along the last parallel transit path Tc9, the sprayer unit 8 reaches an end position Tcf of the coating trajectory Tc. At this time, the sprayer unit 8 stops the spraying of paint and completes the coating of the panel 11.

Figure 5:
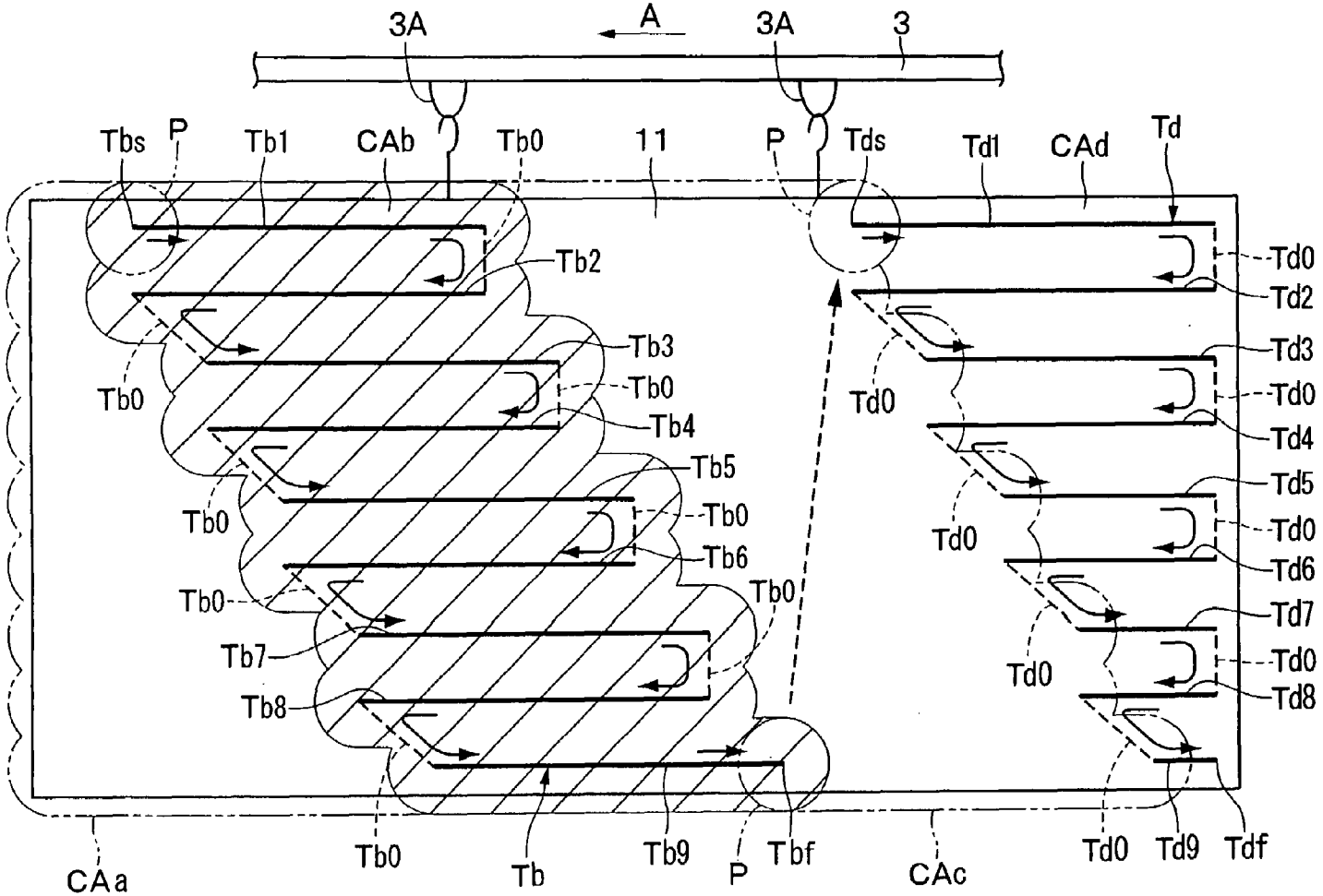
FIG. 5 is a front view of the panel in FIG. 2 coated the middle front coating area in the conveying direction.

A third coating process will now be described while referring to FIGS. 2 and 5. In the third coating process, when the panel 11 is moved by the conveyer 3 to the vicinity of the sprayer unit 9 located to the front side (downstream) in the conveying direction, the controller 10 employs the front robot device 7 and the sprayer unit 9 (the sprayer unit 9 on the left in FIG. 1) and begins the coating of coating area CAb which is the middle front portion of the coating surface of the panel 11 in the conveying direction. At this time, as shown in FIGS. 2 and 5, the sprayer unit 9 moves to the vicinity of the terminal end of the parallel transit path Ta1 as a start position Tbs of the coating trajectory Tb and begins the spraying of paint. Then, the sprayer unit 9 forms a spray pattern P, and while continuing the spraying of paint, moves across the upper end side of the panel 11 along the first parallel transit path Tb1 from the front side to the rear side in the conveying direction (opposite to the conveying direction). At this time, the parallel transit path Tb1 is aligned substantially linearly with the parallel transit path Ta1, and also with the parallel transit path Tc1.

Sequentially, the sprayer unit 9 moves in parallel with a predesignated distance to the opposite direction to the conveying direction of the panel 11, and reaches the terminal end of the parallel transit path Tb1. Since at this time the sprayer unit 9 is positioned near the start end of the parallel transit path Tc1, the sprayer unit 9 temporarily cuts the spraying of paint and moves downward on the panel 11 along the turning path Tb0.

The sprayer unit 9 moves downward from the parallel transit path Tb1 a distance equivalent to the first turning path Ta0 and reaches the terminal end of the first turning path Tb0. Thereafter, the sprayer unit 9 resumes the spraying of paint, and moves along the second parallel transit path Tb2 from the rear to the front in the conveying direction (forward in the conveying direction). In this manner, the sprayer unit 9 repeats the reciprocation in the conveying direction and gradually moves downward on the panel 11.

During this process, the positions of the four turning paths Tb0 located at the boundary between the coating areas CAb, CAc, are sequentially shifted a distance ΔL from the front side to the rear side in the conveying direction. Further, the positions of the four turning paths Tb0 located at the boundary between the coating areas CAa, CAb are also sequentially shifted the distance ΔL from the front side to the rear side in the conveying direction (see FIG. 2).

Therefore, regarding to the coating trajectory Tb, the side portion at the boundary between the coating areas CAb, CAc is formed like a series of steps, and the side portion at the boundary between the coating areas CAa, CAb is also formed like a series of steps. Thus, a whole of the coating trajectory Tb forms a quadrilateral shape. In addition, the parallel transit paths Tb1 to Tb9 are aligned substantially linearly with the parallel transit paths Ta1 to Ta9, and also with the parallel transit paths Tc1 to Tc9.

Finally, as shown in FIG. 5, the sprayer unit 9 moves across the lower end side of the panel 11 along the last parallel transit path Tb9 in the opposite direction to the conveying direction. Once the sprayer unit 9 reaches an end position Tbf of the coating trajectory Tb, the sprayer unit 9 temporarily cuts the spraying of paint and moves to a start position Tds of the coating trajectory Td in the next coating area CAd. At this time, the sprayer unit 9 skips the coating area Cac, which is adjacent to the coating area CAb, and moves toward the coating area CAd located to the rear in the conveying direction further than the coating area CAc.

A fourth coating process will now be described while referring to FIGS. 2 and 6. In the fourth coating process, when the panel 11 is conveyed by the conveyer 3, the coating area CAd which is the rear end portion of the coating surface of the panel 11 in the conveying direction is positioned near the sprayer unit 9 (the sprayer unit 9 on the left in FIG. 1) that has completed the coating of the coating area CAb.

Then, the controller 10 employs the robot device 7 and the sprayer unit 9 which are located to the front side in the conveying direction same as the coating area CAb, and begins the coating of the coating area CAd which is the rear end portion of the coating surface of the panel 11 in the conveying direction. At this time, as a start position Tds of the coating trajectory Td, the sprayer unit 9 moves to the vicinity of the terminal end of the first parallel transit path Tc1 on the upper side of the panel 11 and begins spraying of paint. Then, while continuing the spraying of paint, the sprayer unit 9 moves across the upper end side of the panel 11 along the first (beginning) parallel transit path Td1 from the front side to the rear side in the conveying direction (opposite to the conveying direction). At this time, the parallel transit path Td1 is aligned substantially linearly with the parallel transit paths Ta1, Tb1, Tc1.

Next, the sprayer unit 9 moves in parallel with a predesignated distance in opposite direction to the conveying direction of the panel 11 and reaches the terminal end of the parallel transit path Td1. Then, since the sprayer unit 9 is positioned at the terminal end of the panel 11, the sprayer unit 9 temporarily cuts the spraying of paint and moves downward on the panel 11 along the first turning path Td0.

Sequentially, when the sprayer unit 9 has moved downward from the parallel transit path Td1 a distance equivalent to the first turning path Ta0 and has reached the terminal end of the first turning path Td0, the sprayer unit 9 resumes the spraying of paint and moves along the second parallel transit path Td2 from the rear side to the front side in the conveying direction (forward in the conveying direction). In this manner, the sprayer unit 9 repeats the reciprocation in the conveying direction, and gradually moves downward on the panel 11. At this time, the positions of the four turning paths Td0 located at the boundary between the coating areas CAc, CAd are sequentially shifted the distance ΔL from the front side to the rear side in the conveying direction (see FIG. 2).

As a result, the side portion at the boundary between the coating areas CAc, Cad of the coating trajectory Td is formed like a series of steps. Further, the parallel transit paths Td1 to Td9 are aligned substantially linearly with the parallel transit paths Ta1 to Ta9, Tb1 to Tb9, Tc1 to Tc9.

Figure 6:
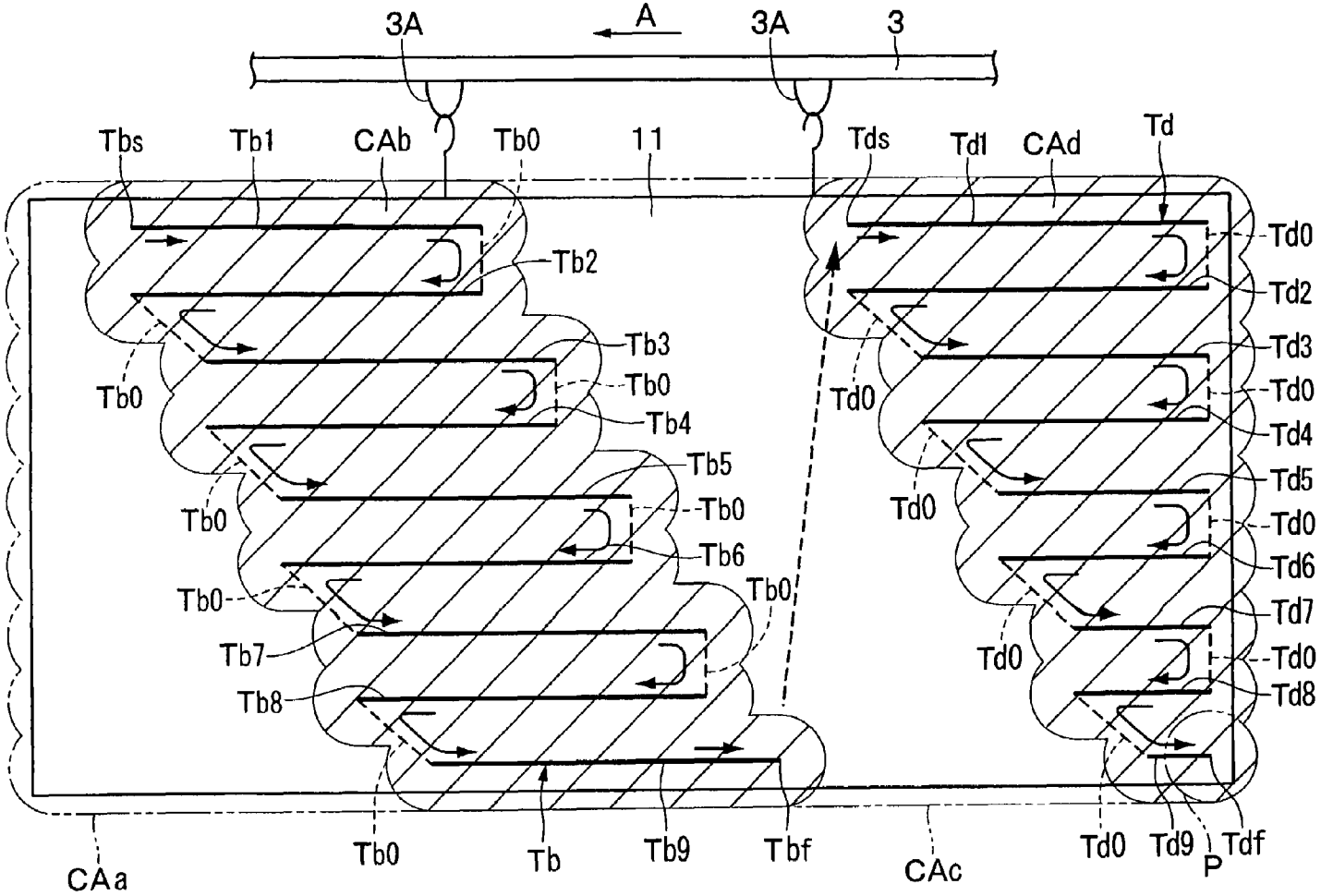
FIG. 6 is a front view of the panel in FIG. 2 sequential to FIG. 5 coated the rear end coating area in the conveying direction.

Finally, as shown in FIG. 6, the sprayer unit 9 moves across the lower end side of the panel 11 along the last parallel transit path Td9 in the opposite direction to the conveying direction. Thus, the sprayer unit 9 reaches an end position Tdf of the coating trajectory Td, and the sprayer unit 9 stops the spraying of paint and completes the coating of the panel 11.

Besides, the sprayer unit 9 located to the front side (downstream) in the conveying direction may begin the coating of the coating area CAb either after the sprayer unit 8 located to the rear side (upstream) in the conveying direction has completed the coating of the coating areas CAa, CAc, or while the sprayer unit 8 is coating the coating area CAc. That is, if the two sprayer units 8, 9 do not interfere with each other, the sprayer units 8, 9 may simultaneously perform coating operations.

As described above, according to the first embodiment, while the sprayer units 8, 9 reciprocate substantially parallel to the conveying direction of the panel 11, the coating is performed by sequentially shifting the positions of the turning paths Ta0, Tb0, Tc0, Td0 from the front side to the rear side in the conveying direction of the panel 11. Therefore, compared with the case that the positions of the turning paths Ta0, Tb0, Tc0, Td0 are fixed, the coating available range of one sprayer unit 8 or 9 can be substantially expanded.

Specifically, the panel 11 is gradually moved away from the front of the sprayer units 8, 9 by conveying the panel 11. Therefore, when the sprayer units 8, 9 repeat the reciprocation, the coating available ranges are gradually shifted to the rearward of the panel 11 in the conveying direction. Thus, the position of the coating available range differs between when the coating of the individual coating areas CAa to CAd is begun and when the coating is ended.

Figure 7:
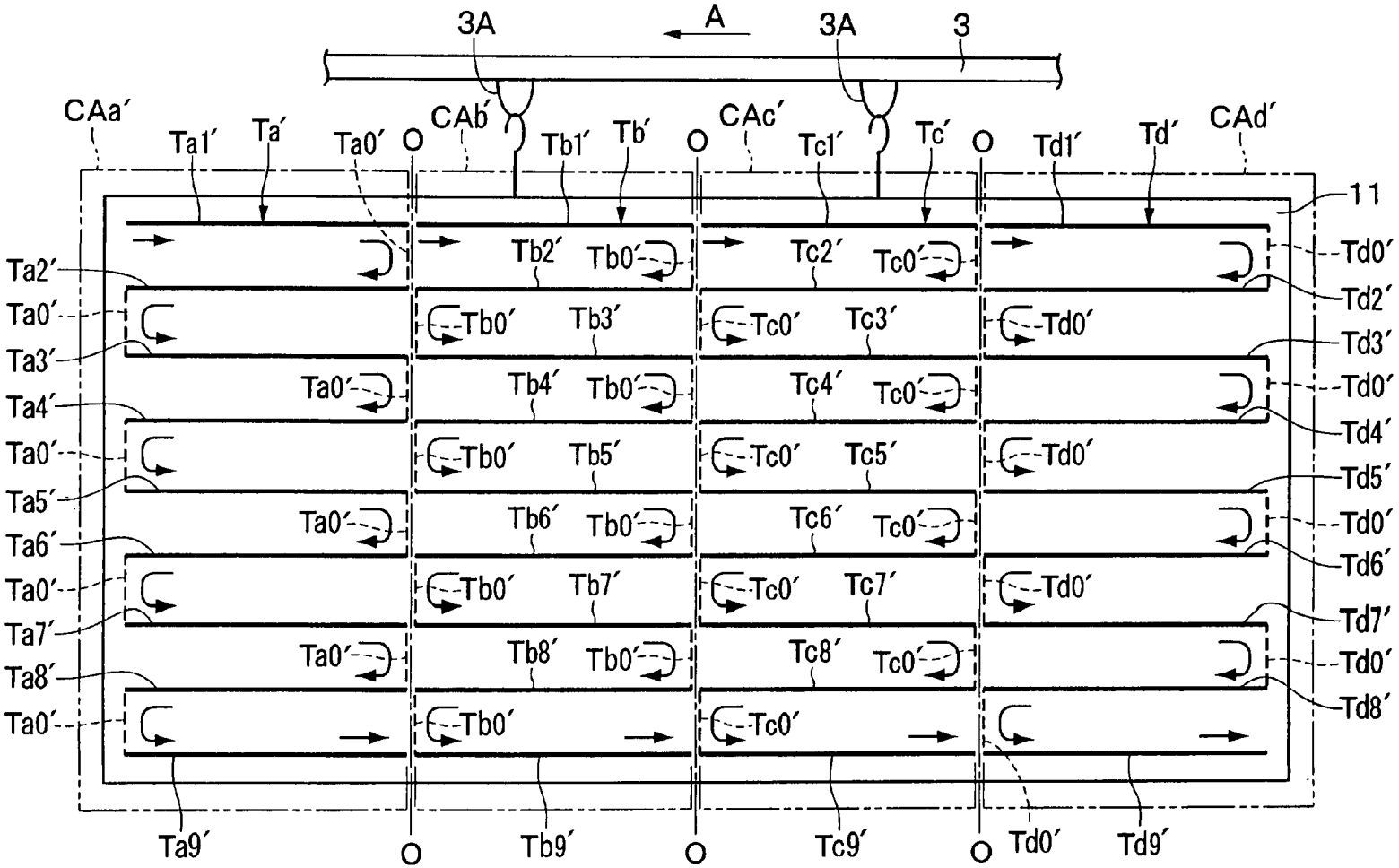
FIG. 7 is a front view of the coating trajectories of a sprayer unit for coating a panel by using a coating method according to a first comparison example.

Therefore, a comparison is made for a case as shown in FIG. 7 wherein the positions of the turning paths are not changed. As shown in a first comparison example in FIG. 7, the positions of turning paths Ta0', Tb0', Tc0', Td0' for reciprocation must be fixed within a limited area wherein the coating available range at the coating start time and the coating available range at the coating end time are overlapped. As a result, the coating available ranges of the individual sprayer units 8, 9 are limited to the range smaller than the maximum stroke width Smax, i.e., they become narrower.

On the other hand, according to the arrangement for this embodiment, in the adjacent coating areas CAa to CAd, the positions of the turning paths Ta0, Tb0, Tc0, Td0 for reciprocation of the sprayer units 8, 9 are sequentially shifted from the front side to the rear side in the conveying direction of the panel 11. Therefore, even when the panel 11 is gradually moved away from the sprayer units 8, 9, as the sprayer units 8, 9 repeat the reciprocation, the reciprocating ranges are gradually shifted to the rearward in the conveying direction of the panel 11. As a result, the coating available ranges of the sprayer units 8, 9 can be substantially expanded without limitation of an area wherein the coating available range at the coating start time and the coating available range at the coating end time are overlapped.

Thus, since the individual sprayer units 8, 9 can perform coating up to a range near the maximum stroke width Smax, the size of the area coated by each of the sprayer units 8, 9 can be expanded and the coating capacity can be improved. Therefore, for example, even when the speed for conveying the panel 11 is increased and the size of the area coated per unit hour is expanded, the number of sprayer units 8, 9 required for the coating apparatus 1 (the entire coating line) can be reduced and the running distances (traveling distances) of the tracking devices 4, 5 can be shortened.

Furthermore, when the speed for conveying the panel 11 is comparatively low, coating can be performed without employing the tracking devices 4, 5. As a result, the initial costs, such as the equipment cost for the coating apparatus 1 can be reduced and the size of the coating booth 2 can be small. Accordingly, the operating costs associated with the air conditioner of the coating booth 2 and the maintenance of the sprayer units 8, 9 can be reduced.

In addition, the positions of the turning paths Ta0, Tb0, Tc0, Td0 for the reciprocation of the sprayer units 8, 9 are sequentially shifted in a predetermined direction in the opposite direction of the conveying direction and the coating trajectories Ta, Tb, Tc, Td of the turning paths Ta0, Tb0, Tc0, Td0 are formed like a series of steps. Therefore, for example, the third turning path Ta0 located between the parallel transit paths Ta3, Ta4 of the coating trajectory Ta is positioned adjacent to the fifth parallel transit path Ta5 that is extended across the turning path Ta0. At this time, when coating is performed along the parallel transit path Ta5, the obtained spray pattern P also overlaps with the third turning path Ta0.

Furthermore, the second parallel transit path Tb2 of the coating trajectory Tb is positioned adjacent to the third turning path Ta0. Thus, when coating is performed along the second parallel transit path Tb2, the obtained spray pattern P overlaps with the third turning path Ta0.

Similarly, the turning paths Ta0, Tb0, Tc0, Td0 located at the boundary between the two of coating areas CAa, CAb, CAc, CAd, overlap with spray patterns P when coating is to be performed for adjacent parallel transit paths Ta1 to Ta9, Tb1 to Tb9, Tc1 to Tc9, Td1 to Td9. Therefore, the spray patterns P associated with the coating of the parallel transit paths Ta1 to Ta9, Tb1 to Tb9, Tc1 to Tc9, Td1 to Td9 can be overlapped with the turning paths Ta0, Tb0, Tc0, Td0.

As a result, the number of coating of spray patterns P on the turning paths Ta0, Tb0, Tc0, Td0, the thickness of the coated film and so forth can be near the other portions (parallel transit paths Ta1 to Ta9, Tb1 to Tb9, Tc1 to Tc9, Td1 to Td9). Therefore, color shading at the turning paths Ta0, Tb0, Tc0, Td0 can be reduced and the finished coating can be improved.

Figure 8:
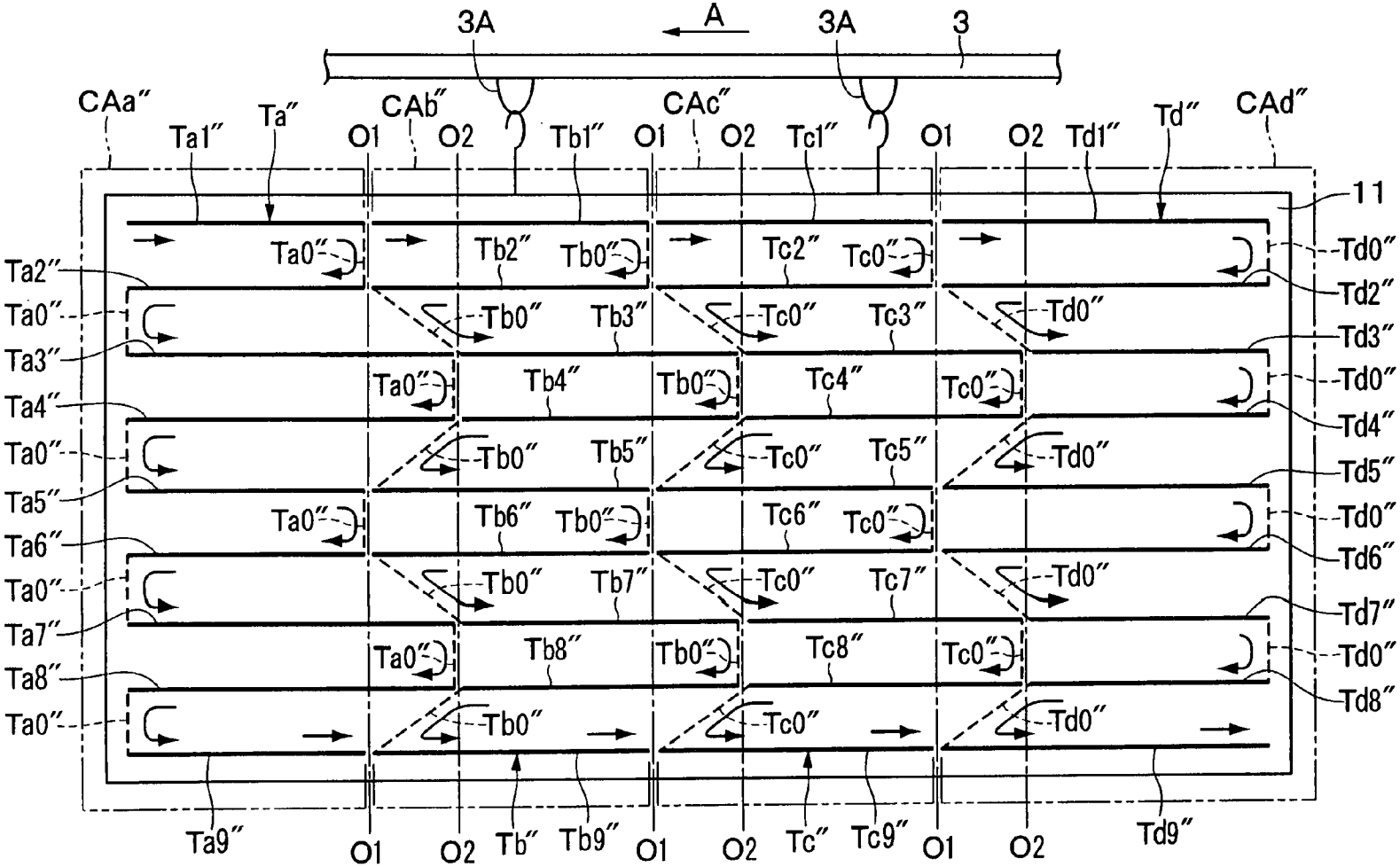
FIG. 8 is a front view of the coating trajectories of the sprayer unit for coating a panel by using a coating method according to a second comparison example.

The finished coating for this embodiment is to be compared with a first comparison example and a second comparison example shown in FIGS. 7 and 8.

Initially, the first comparison example is shown in FIG. 7. According to the first comparison example, turning paths Ta0', Tb0', Tc0', Td0' are located at almost the same positions on the panel 11 in the lateral direction to form coating trajectories Ta', Tb', Tc', Td'. In this case, the turning paths Ta0', Tb0', Tc0', Td0' are concentrically located as arrays at the boundaries of the coating areas CAa', CAb', CAc', CAd'. Therefore, as indicated by chain lines O in FIG. 7, lines of color shading by unevenness tend to occur at the individual boundaries of the coating areas CAa', CAb', CAc', CAd'.

The second comparison example is shown in FIG. 8. According to the second comparison example, turning paths Ta0", Tb0", Tc0", Td0" are alternately moved laterally to the panel 11 to form coating trajectories Ta", Tb", Tc", Td" that have a comb-toothed shape (a zigzag shape). In this case, the turning paths Ta0", Tb0", Tc0", Td0" are arranged as two arrays at the individual boundaries of the coating areas CAa", CAb", CAc", CAd". Thus, as indicated by chain lines O1, O2 in FIG. 8, two arrays of color shading by unevenness tend to occur at individual boundaries of the coating areas CAa", CAb", CAc", CAd".

On the other hand, according to the first embodiment, since the coating trajectories Ta, Tb, Tc, Td are formed like a series of steps, the positions of the turning paths Ta0, Tb0, Tc0, Td0 can be shifted in the predetermined direction. As a result, the turning paths Ta0, Tb0, Tc0, Td0 can be spread and arranged on the panel 11, and color shading can be reduced on the entire coating surface, and the quality of the finished coating can be increased.

Further, at the first parallel transit paths Ta1, Tb1, Tc1, Td1 being the start positions Tas, Tbs, Tcs, Tds of the coating trajectories Ta, Tb, Tc, Td, coating is performed by moving the sprayer units 8, 9 from the front side to the rear side in the conveying direction of the panel 11 (the opposite of the conveying direction). Also in this arrangement, at the last parallel transit paths Ta9, Tb9, Tc9, Td9 being the end positions Taf, Tbf, Tcf, Tdf, coating is performed by moving the sprayer units 8, 9 from the front side to the rear side in the conveying direction of the panel 11 (the opposite of the conveying direction). Therefore, when coating of the coating area CAa is completed and coating of the next coating area CAc is to be performed, the end position Taf of the coating trajectory Ta after the coating has been completed can be arranged near the start position Tcs of the coating trajectory Tc before coating is begun.

A comparison is made for a case that the last parallel transit path Ta9 is coated from the rear side to the front side in the conveying direction (forward in the conveying direction). In this case, the coating for the coating area CAa is completed on the front side in the conveying direction. Therefore, the coating area CAa must be skipped in order to move to the next coating area CAc. As a result, the end position Taf of the coating trajectory Ta is separated from the start position Tcs of the coating trajectory Tc a distance equivalent to the length of the coating area CAa that is skipped.

Further, a comparison is made for a case that the first parallel transit path Tc1 is coated forward in the conveying direction. In this case, the coating area CAc must be skipped in order to move from the coating area CAa to the coating area CAc. Therefore, in this case also, the end position Taf of the coating trajectory Ta is separated from the start position Tcs of the coating trajectory Tc a distance equivalent to the length of the coating area CAc that is skipped. Thus, the time that the coating is cut is extended and the coating efficiency is deteriorated.

On the other hand, according to the first embodiment, at the first parallel transit paths Ta1, Tb1, Tc1, Td1 and at the last parallel transit paths Ta9, Tb9, Tc9, Td9, coating is performed by moving the sprayer unit 8, 9 in a opposite direction to the conveying direction of the panel 11. Therefore, the distances between the start positions Tas, Tbs, Tcs, Tds and the end positions Taf, Tbf, Tcf, Tdf can be shortened. As a result, since the time that the coating is halted can be reduced, the size of the area coated by a sprayer unit 8, 9 can be increased and the coating efficiency can be improved.

Furthermore, according to this embodiment, coating is performed so that the parallel transit paths Ta1 to Ta9, Tb1 to Tb9, Tc1 to Tc9, Td1 to Td9 in the coating areas CAa, CAb, CAc, CAd which are adjacent to each other are aligned substantially linearly. Therefore, the parallel transit paths Ta1 to Ta9, Tb1 to Tb9, Tc1 to Tc9, Td1 to Td9 can be linearly continued. As a result, the same quality for the finished coating can be acquired as is obtained when the entire coating surface of the panel 11 is regarded as a single coating area.

In addition, according to the arrangement of this embodiment, at the parallel transit paths Ta1 to Ta9, Tb1 to Tb9, Tc1 to Tc9, Td1 to Td9, the paint is sprayed by the sprayer units 8, 9, and at the turning paths Ta0, Tb0, Tc0, Td0, the spraying of paint by the sprayer units 8, 9 is cut. Therefore, compared with the case that the spraying of paint is continued at the turning paths Ta0, Tb0, Tc0, Td0, the thickness of the coated film on the turning paths Ta0, Tb0, Tc0, Td0 can be reduced. As a result, the thickness of the coated film along the turning paths Ta0, Tb0, Tc0, Td0 can be near the thickness of the coated film along the parallel transit paths Ta1 to Ta9, Tb1 to Tb9, Tc1 to Tc9, Td1 to Td9. Thus, in the adjacent coating areas CAa, CAb, CAc, CAd, the parallel transit paths Ta1 to Ta9, Tb1 to Tb9, Tc1 to Tc9, Td1 to Td9 of the coating trajectories Ta, Tb, Tc, Td can be connected and color shading by unevenness can be prevented at the joint positions. Furthermore, the quality of the finished coating of the entire coating surface of the panel 11 consisting of the coating areas CAa, CAb, CAc, CAd can be improved.

Figure 9:
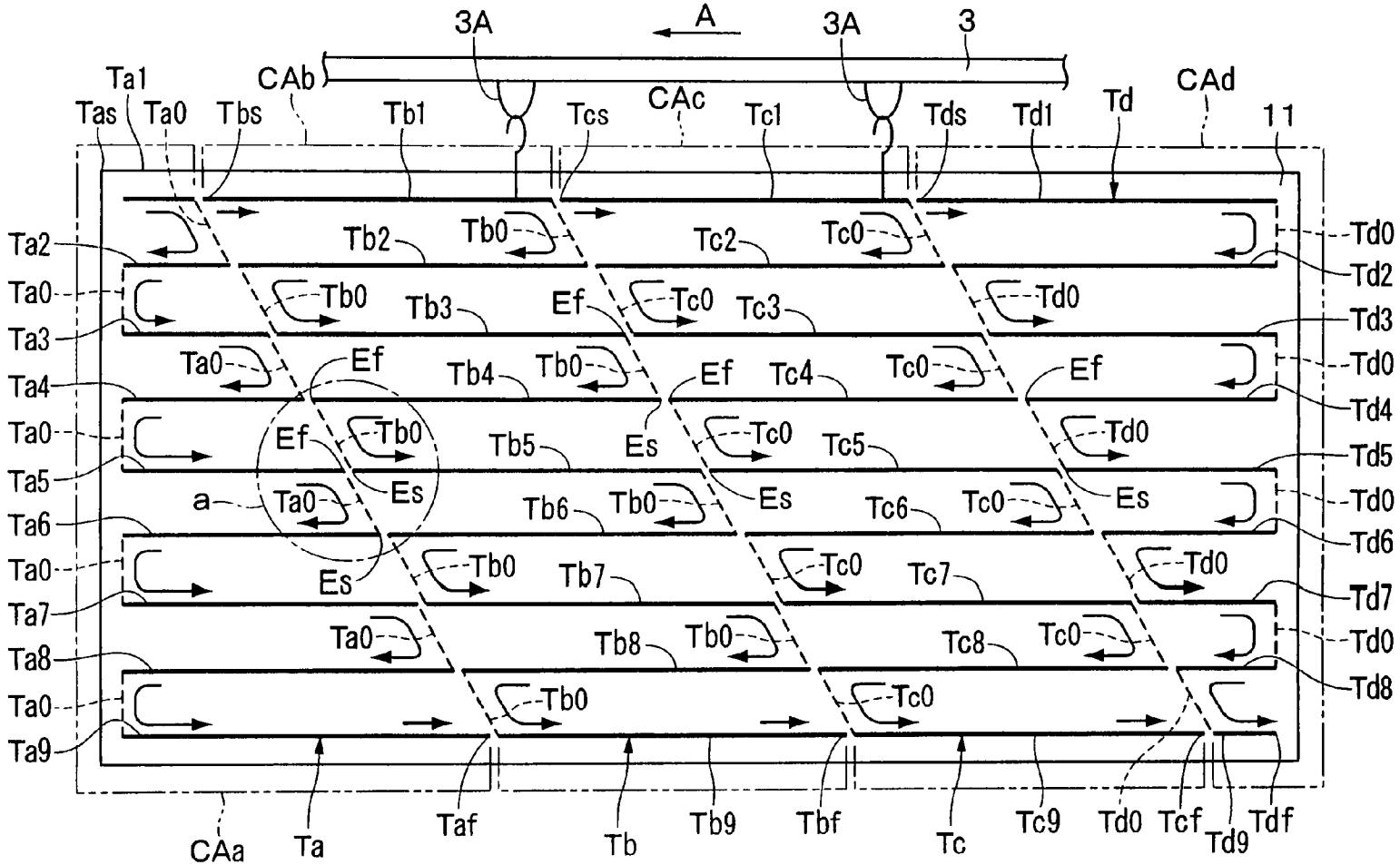
FIG. 9 is a front view of the coating trajectories of a rotary atomizing type sprayer unit for coating a panel by using a coating method according to a second embodiment.
Figure 10:
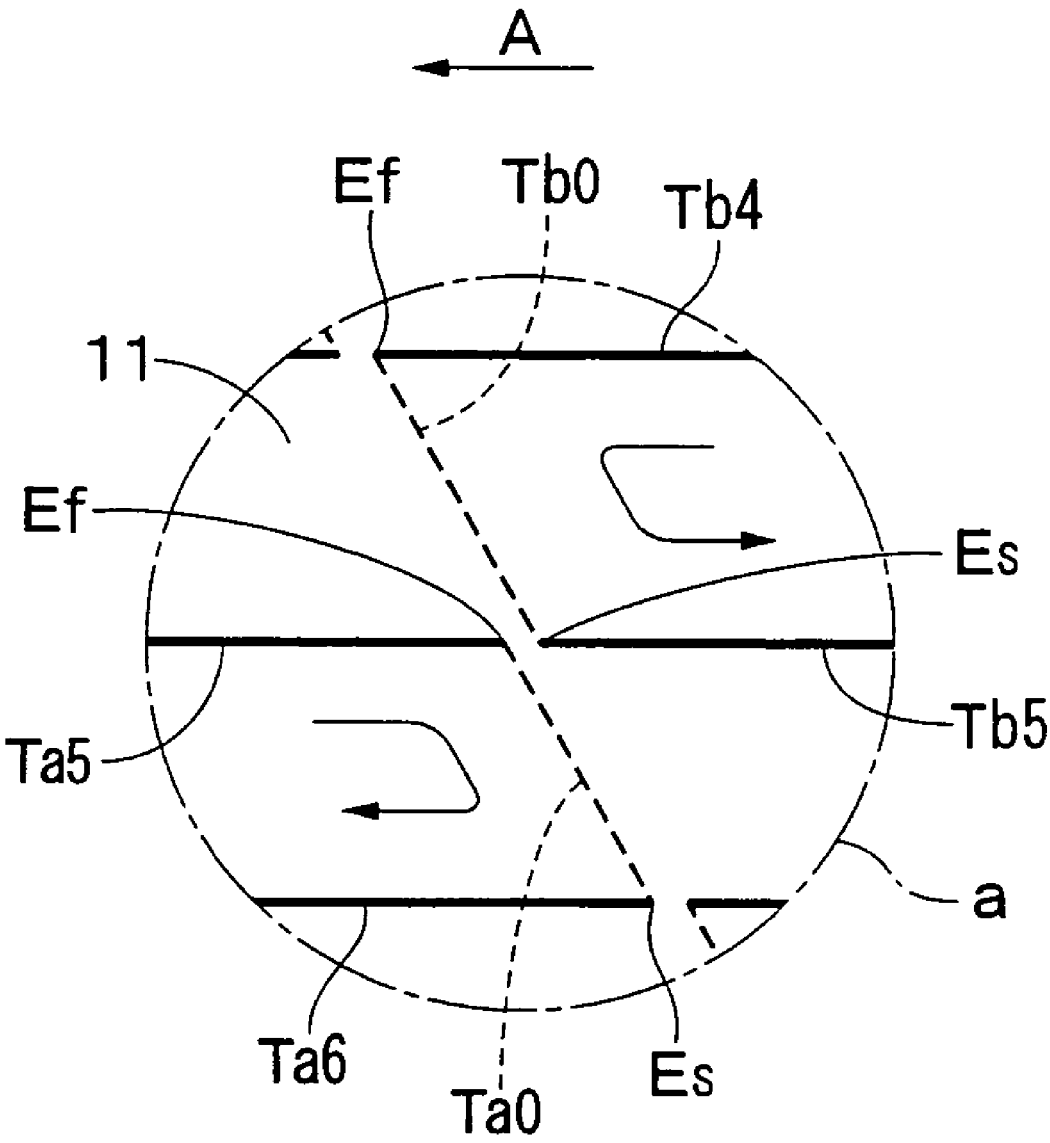
FIG. 10 is an enlarged front view of a coating trajectory at portion a in FIG. 9.

A second embodiment of the present invention is shown in FIGS. 9 and 10. The feature of this embodiment is that coating is performed by shifting the positions of the terminal ends of parallel transit paths along one route for reciprocation and the positions of the start ends of the parallel transit paths along the return route from the front side to the rear side in the conveying direction. In the following description of this embodiment, those component parts which are identical with counterparts in the foregoing first embodiment are simply designated by the same reference numerals or characters to avoid repetitions of same explanations.

In the second embodiment, substantially the same robot devices 6, 7 and sprayer units 8, 9 are employed as are used in the first embodiment and while reciprocating the sprayer units 8, 9 in the conveying direction, coating is performed for the coating surface of a panel 11 that is divided into coating areas CAa to CAd.

Furthermore, as in the first embodiment, the sprayer unit 8 located on the rear side in the conveying direction coats the coating area CAa and then coats the coating area CAc. On the other hand, the sprayer unit 9 located on the front side in the conveying direction coats the coating area CAb and then coats the coating area CAd.

Moreover, in the second embodiment, as in the first embodiment, the coating is performed by sequentially shifting the positions of turning paths Ta0, Tb0, Tc0, Td0 located at the boundaries of the coating areas CAa to CAd from the front side to the rear side in the conveying direction.

However, according to the second embodiment, unlike the first embodiment, when the coating is performed, the positions of terminal ends Ef (e.g., at the rear side in the conveying direction of the parallel transit path Ta5; at the front side in the conveying direction of the parallel transit path Tb4) of the parallel transit paths along one route and the positions of the start ends Es (e.g., at the rear side in the conveying direction of the parallel transit path Ta6; at the front side in the conveying direction, of the parallel transit path Tb5) of the parallel transit paths along the return route for the reciprocation of the individual coating trajectories Ta to Td, are shifted from the front side to the rear side in the conveying direction (see FIG. 10). With this arrangement, the turning paths Ta0, Tb0, Tc0, Td0, located on the side of the boundaries of coating areas CAa to CAd, travel obliquely down while their positions are shifted in an opposite direction of the conveying direction.

Thus, in the above described second embodiment, substantially the same operational effects can be obtained as in the first embodiment. Especially, in the second embodiment, when coating is performed, the positions of the terminal ends Ef of the parallel transit paths along one route for the reciprocation of the coating trajectories Ta to Td and the positions of the start ends Es of the parallel transit paths along the return route are shifted from the front side to the rear side in the conveying direction. With this arrangement, at the turning paths Ta0 to Td0 for the reciprocation of the sprayer units 8, 9, the wasted movements of the sprayer units 8, 9 that temporarily cancel conveyance of the panel 11 can be eliminated, and the practical coating available ranges of the sprayer units 8, 9 can be substantially extended.

Furthermore, since the positions of the ends (the start ends Es; the terminal ends Ef) of the parallel transit paths Ta1 to Ta9, Tb1 to Tb9, Tc1 to Tc9, Td1 to Td9 are shifted along one route and the return route for reciprocation, the occurrence of color shading can be reduced at the ends of the parallel transit paths Ta1 to Ta9, Tb1 to Tb9, Tc1 to Tc9, Td1 to Td9. Thus, the quality of the finished coating can be increased.

Figure 11:
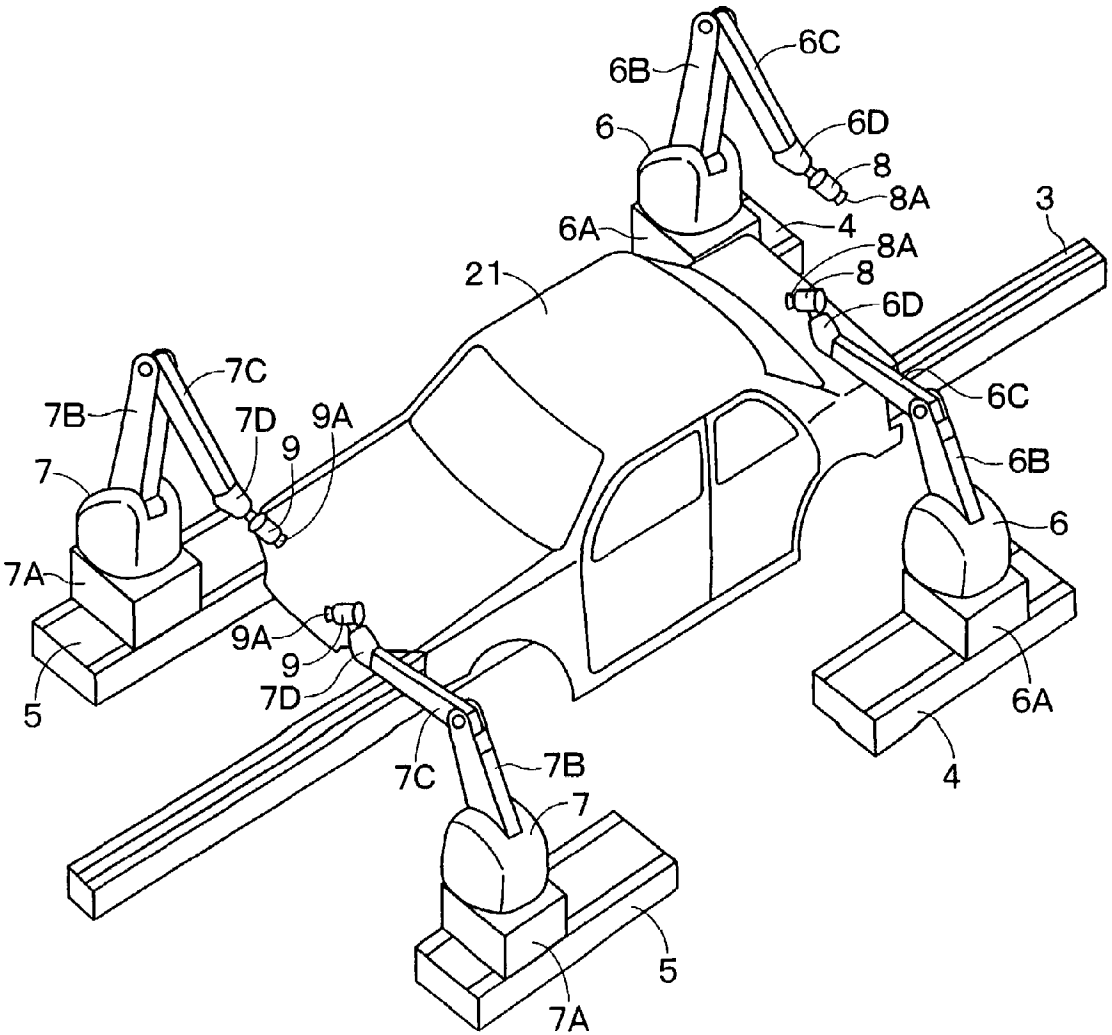
FIG. 11 is a perspective view of a coating apparatus used for a coating method according to a third embodiment.
Figure 12:
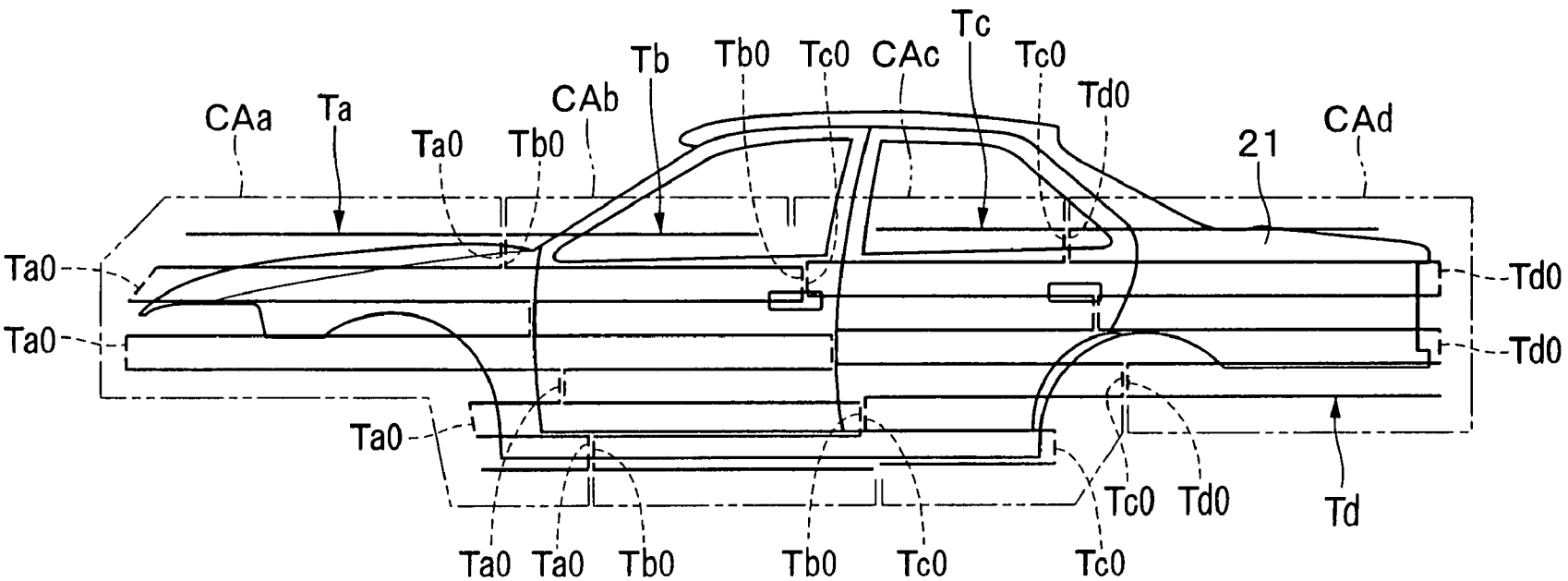
FIG. 12 is a front view of the coating trajectories of a rotary atomizing type sprayer unit for coating the left side surface of an automobile body using a coating method according to the third embodiment.

A third embodiment of the present invention is shown in FIGS. 11 and 12. The feature of this embodiment is that an automobile body is employed as an object to be coated. In the following description of this embodiment, those component parts which are identical with counterparts in the foregoing first embodiment are simply designated by the same reference numerals or characters to avoid repetitions of same explanations.

First, according to the third embodiment, a total of four robot devices 6, 7 as used in the first embodiment are employed as apparatuses for sprayer units. These robot devices 6, 7 are arranged with two units on right side and left side of a car body 21, which is an object to be coated. Rotary atomizing type sprayer units 8, 9, attached to the individual robot devices 6, 7, are designed to reciprocate in a conveying direction of the car body 21 (to the frontward and to the rearward of the car body 21).

When, the left side surface of the car body 21 is coated by using the two robot devices 6, 7 located on the left side of the car body 21, the left side coating surface of the car body 21 is divided into four coating areas CAa to CAd. Then, as in the first embodiment, the robot device 6 (sprayer unit 8) located to the rear side in the conveying direction coats the coating area CAa and then coats the coating area CAc. On the other hand, the robot device 7 (sprayer unit 9) located to the front side in the conveying direction coats the coating area CAb and then coats the coating area CAd.

In the third embodiment, as in the first embodiment, when coating is performed, the positions of turning paths Ta0 to Td0, located at the boundaries of the coating areas CAa to Cad, are shifted from the front side to the rear side in the conveying direction. Furthermore, the turning paths Ta0 to Td0 of the coating trajectories Ta to Td are arranged at positions where color shading is not noticeable, such as places where parts are assembled after the car body 21 has been coated (e.g., where door knobs are positioned), or at boundary portions of different parts (e.g., the boundary between a fender and a door). As a result, color shading is prevented from being visually identified, and the quality of the finished coating can be practically improved.

In conclusion, according to above described arrangement provided for the third embodiment, substantially the same advantageous effects can be obtained as in the first embodiment.

In the third embodiment, only the method for coating the left side surface of the car body 21 has been explained. However, the same coating method can be applied for the right side surface, the bonnet and the roof of the car body 21.

Further, in the third embodiment, as in the first embodiment, when coating is performed, the terminal ends of the parallel transit paths along one route for reciprocation have been arranged substantially at the same positions in the conveying direction as the start ends of the parallel transit paths along the return route. However, the present invention is not limited to this arrangement. For example, as in the arrangement of the second embodiment, when coating is performed, the start ends of the parallel transit paths along the return route may be shifted to the rear side in the conveying direction compare with the terminal ends of the parallel transit paths along one route for the reciprocation.

Furthermore, according to the arrangements in the first and second embodiments, for the first parallel transit paths Ta1 to Td1 that have the start positions Tas to Tds and the last parallel transit paths Ta9 to Td9 that have the end positions Taf to Tdf, coating has been performed by moving the sprayer units 8, 9 in an opposite direction to the conveying direction. However, the present invention is not limited to this arrangement. Coating may be performed by moving the sprayer units 8, 9 forward in the conveying direction along either or both of the first parallel transit paths Ta1 to Td1 and the last parallel transit paths Ta9 to Td9.

Further, according to the above described individual embodiments, the coating trajectories Ta to Td have been formed from the top to the bottom of the panel 11 or the car body 21. However, coating may be performed while the coating trajectories are formed from the bottom to the top of a panel.

In addition, according to the arrangement for the individual embodiments described above, spraying of the paint has been cut at the turning paths Ta0 to Td0 of the coating trajectories Ta to Td. However, the present invention is not limited to this arrangement, spraying of paint may be continued at the turning paths of the coating trajectories. As an arrangement for this case, in the side of the boundary between adjacent coating areas, a predetermined gap is defined between the turning paths in one coating area and the turning paths in the other coating area to prevent an increase in the thickness of the coated film at the boundary.

Moreover, according to the arrangement for the individual embodiments, the panel 11 having a plate shape or the car body 21 of an automobile has been employed for coating. However, another object may be employed so long as a surface to be coated is large and can be divided into a plural number of coating areas, and, for example, the body of a large vehicle, such as a bus and a train, can be employed.

Also, according to the arrangement for the individual embodiments, the sprayer units 8, 9 of a rotary atomizing type have been employed. However, sprayer units of a spray gun type may be employed, and not only an apparatus of an electrostatic coating type, but also a coating apparatus of another type may be employed.

The invention claimed is:

1. A coating method, comprising:

conveying an object to be coated in a predetermined conveying direction;

dividing a coating surface of the object to be coated into a plural number of coating areas; and performing coating with individual sprayer units reciprocating along said coating areas substantially parallel to the conveying direction of said object such that adjacent coating areas of said plural number of coating areas are respectively coated by a different one of the sprayer units, wherein during the performing the coating of at least two of the adjacent coating areas in the conveying direction, when said sprayer units are reciprocating substantially parallel to said conveying direction of said object, positions of turning paths for reciprocation, located at a boundary between the adjacent coating areas such that the adjacent coating areas abut along the boundary, are sequentially shifted from a front side to a rear side in said conveying direction of said object, and the coating is performed while forming a coating trajectory of said turning paths like a series of steps such that each successive one of the turning paths of each respective one of the adjacent coating areas on the boundary extends further in a direction opposite to the conveying direction than each previous one of the turning paths of the respective one of the adjacent coating areas.

2. A coating method as defined in claim 1, wherein at a first parallel transit path of parallel transit paths for the reciprocation of said sprayer units being start positions of the coating trajectories in said individual coating areas, the coating is performed while moving said sprayer units from the front side to the rear side in said conveying direction, and at a last parallel transit path being end positions of said coating trajectories in said individual coating areas, the coating is performed while moving said sprayer units from the front side to the rear side in said conveying direction.

3. A coating method as defined in claim 1, wherein parallel transit paths for the reciprocation of each of said sprayer units are aligned substantially linearly in said adjacent coating areas.

4. A coating method as defined in claim 1, wherein the coating is performed in a manner such that positions of terminal ends of parallel transit paths in one direction for said reciprocation of said sprayer units and start ends of parallel transit paths in a return direction are shifted from the front side to the rear side in said conveying direction of said object.

5. A coating method as defined in claim 1, wherein the coating is performed in a manner such that paint is sprayed by said sprayer units at parallel transit paths and is turned off at said turning paths for said reciprocation during said reciprocation of said sprayer units.

6. A coating method as defined in claim 1, wherein during the performing the coating of the at least two adjacent coating areas, the coating is performed while forming the coating trajectory of the turning paths such that each successive one of the turning paths on the rear side of the boundary extends further away from the conveying direction than each previous one of the turning paths.

7. A coating method as defined in claim 1, wherein the turning paths on the front side of the boundary each link two parallel transit paths for the reciprocation of the sprayer units, the turning paths are sequentially shifted from the front side to the rear side in said conveying direction of said object, and the portion of each of the turning paths that links the two parallel transit paths is not perpendicular to the two parallel transit paths.

8. A coating method, comprising:

conveying an object to be coated in a predetermined conveying direction;

dividing a coating surface of the object to be coated into a plurality of coating areas; and performing coating with a first sprayer unit and a second sprayer unit each reciprocating along said coating areas substantially parallel to the conveying direction of said object such that adjacent coating areas of said coating areas are respectively coated by a different one of the sprayer units, wherein during the performing the coating of at least two of the adjacent coating areas, positions of turning paths for reciprocation of the sprayers units are sequentially shifted from a front side to a rear side in said conveying direction of said object, a coating trajectory of the turning paths for reciprocation of the first sprayer unit is formed such that each successive one of the turning paths on the rear side of a boundary of a first coating area extends further in a direction opposite to the conveying direction than each previous one of the turning paths, and a coating trajectory of the turning paths for reciprocation of the second sprayer unit is formed such that each successive one of the turning paths on the front side of a boundary of a second coating area, which is adjacent to the first coating area, extends further in the direction opposite to the conveying direction than each previous one of the turning paths, and the boundary of the first coating area abuts the boundary of the second coating area such that the adjacent coating areas abut along the boundary of the first coating area and the boundary of the second coating area.

9. A coating method as defined in claim 1, wherein during the performing the coating of one of the adjacent coating areas in the conveying direction, the turning paths of the sprayer unit that is performing the coating do not cross the boundary between the adjacent coating area.

10. A coating method as defined in claim 8, wherein during the performing the coating of the first coating area, the turning paths of the first sprayer unit do not cross the boundary of the second coating area.

11. A coating method as defined in claim 8, wherein during the performing the coating of the second coating area, the turning paths of the second sprayer unit do not cross the boundary of the first coating area.

* * * * *